US012298025B2

(12) United States Patent
Takigawa

(10) Patent No.: US 12,298,025 B2
(45) Date of Patent: May 13, 2025

(54) AIR CONDITIONER

(71) Applicant: Mitsubishi Electric Corporation, Tokyo (JP)

(72) Inventor: Yohei Takigawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 147 days.

(21) Appl. No.: 18/250,801

(22) PCT Filed: Feb. 3, 2021

(86) PCT No.: PCT/JP2021/003943
§ 371 (c)(1),
(2) Date: Apr. 27, 2023

(87) PCT Pub. No.: WO2022/168204
PCT Pub. Date: Aug. 11, 2022

(65) Prior Publication Data
US 2023/0400216 A1 Dec. 14, 2023

(51) Int. Cl.

| | |
|---|---|
| ***F24F 11/86*** | (2018.01) |
| ***F24F 1/20*** | (2011.01) |
| ***F24F 1/22*** | (2011.01) |
| ***F24F 11/63*** | (2018.01) |
| ***F24F 11/88*** | (2018.01) |

(52) U.S. Cl.
CPC ..... *F24F 11/86* (2018.01); *F24F 1/20* (2013.01); *F24F 1/22* (2013.01); *F24F 11/63* (2018.01); *F24F 11/88* (2018.01); *F25B 2600/021* (2013.01)

(58) Field of Classification Search
CPC ..... F25B 2600/021; F24F 1/20; F24F 1/22; F24F 11/63; F24F 11/86; F24F 11/88
See application file for complete search history.

(56) References Cited

U.S. PATENT DOCUMENTS 10,742,023 B2 8/2020 Sakurai et al.

FOREIGN PATENT DOCUMENTS

| | | | |
|---|---|---|---|
| JP | S61-194944 | A | 8/1986 |
| JP | 2005-253282 | A | 9/2005 |
| JP | 2012-047367 | A | 3/2012 |
| JP | 2012-251710 | A | 12/2012 |
| JP | 2013-137138 | A | 7/2013 |
| JP | 2015-148372 | A | 8/2015 |
| WO | 2017/119084 | A1 | 7/2017 |
| WO | 2018/011909 | A1 | 1/2018 |

OTHER PUBLICATIONS

International Search Report of the International Searching Authority mailed Apr. 13, 2021 in corresponding International Application No. PCT/JP2021/003943 (and English translation).

*Primary Examiner* — Jonathan Bradford
(74) *Attorney, Agent, or Firm* — Posz Law Group, PLC

(57) ABSTRACT

An air conditioner includes an outdoor unit including a three-phase AC power supply, a compressor that compresses a refrigerant, and an inverter circuit that controls the compressor. The outdoor unit includes a driving microcomputer that drives the inverter circuit, a second diode bridge connected to the inverter circuit, a first relay disposed on a first wiring line, a second relay disposed on a third wiring line, an inrush-prevention resistor, and a third relay connected to the first wiring line and the inrush-prevention resistor. After the compressor stops, the driving microcomputer brings the first relay, the second relay, and the third relay into an off state.

3 Claims, 7 Drawing Sheets

AIR CONDITIONER

CROSS-REFERENCE TO RELATED APPLICATION

This application is a U.S. National Stage Application of International Application No. PCT/JP2021/003943 filed on Feb. 3, 2021, the contents of which are incorporated herein by reference.

TECHNICAL FIELD

The present disclosure relates to an air conditioner including an outdoor unit including a three-phase AC power supply, an inverter circuit, and a diode bridge.

BACKGROUND

In a conventional air conditioner in which a plurality of indoor units, a remote controller, and a centralized controller are connected to an outdoor unit, power is supplied to the outdoor unit to maintain communication between the outdoor unit and the plurality of indoor units, the remote controller, and the centralized controller even while the operation is stopped, and electric power is constantly supplied to an unused inverter circuit inside the outdoor unit (see, for example, Patent Literature 1). The constant supply of electric power to the inverter circuit contributes to an increase in power consumption during standby.

In order to reduce power consumption during standby, there has been proposed a circuit that cuts off energization to an outdoor unit during standby to reduce electric power consumption by an unused circuit (see, for example, Patent Literature 2).

PATENT LITERATURE

Patent Literature 1: Japanese Patent Application Laid-open No. S61-194944

Patent Literature 2: International Publication No. 2018/011909

However, in a conventional air conditioner in which a plurality of indoor units, a remote controller, and a centralized controller are connected to an outdoor unit, the outdoor unit needs to constantly communicate with the plurality of indoor units, the remote controller, and the centralized controller, and cannot cut off energization to the outdoor unit. Therefore, by energizing an unused inverter circuit and a driving microcomputer that drives the inverter circuit, the air conditioner consumes electric power even during standby.

SUMMARY

The present disclosure has been made in view of the above, and an object thereof is to obtain an air conditioner that reduces power consumption during standby.

In order to solve the above-described problem and achieve the object, an air conditioner according to the present disclosure includes an outdoor unit, a plurality of indoor units connected to the outdoor unit, a plurality of remote controllers, and a centralized controller that controls the outdoor unit. Each of the plurality of remote controllers controls the outdoor unit or a corresponding indoor unit among the plurality of indoor units. The outdoor unit constantly communicates with the plurality of indoor units, the plurality of remote controllers, and the centralized controller. The outdoor unit includes: a three-phase AC power supply; a first diode bridge that rectifies AC power output from the three-phase AC power supply into DC power; a compressor that compresses a refrigerant; a control microcomputer that outputs an instruction for controlling the compressor; and an inverter circuit that controls the compressor. The outdoor unit further includes: a driving microcomputer that drives the inverter circuit; a switching power supply circuit that supplies DC power rectified by the first diode bridge to the control microcomputer and the driving microcomputer; and a second diode bridge connected to the inverter circuit. The outdoor unit further includes: a first wiring line corresponding to an L1 phase and connecting the three-phase AC power supply and the second diode bridge; a second wiring line corresponding to an L2 phase and connecting the three-phase AC power supply and the second diode bridge; and a third wiring line corresponding to an L3 phase and connecting the three-phase AC power supply and the second diode bridge. The outdoor unit further includes: a first relay disposed on the first wiring line; a second relay disposed on the third wiring line; an inrush-prevention resistor that is connected to the second diode bridge side of the first relay and prevents an inrush current flowing when power is turned on; and a third relay connected to the inrush-prevention resistor and a location on the three-phase AC power supply side from the first relay on the first wiring line. After the compressor stops, the driving microcomputer brings the first relay, the second relay, and the third relay into an off state, and disconnects the second diode bridge and the inverter circuit from the three-phase AC power supply. The outdoor unit further includes a power supply regulator having a function of switching output of the driving microcomputer between on and off. The control microcomputer stops the power supply regulator after the compressor stops.

The air conditioner according to the present disclosure has an effect of reducing power consumption during standby.

DETAILED DESCRIPTION

Hereinafter, air conditioners according to embodiments will be described in detail with reference to the drawings.

First Embodiment

Figure 1:
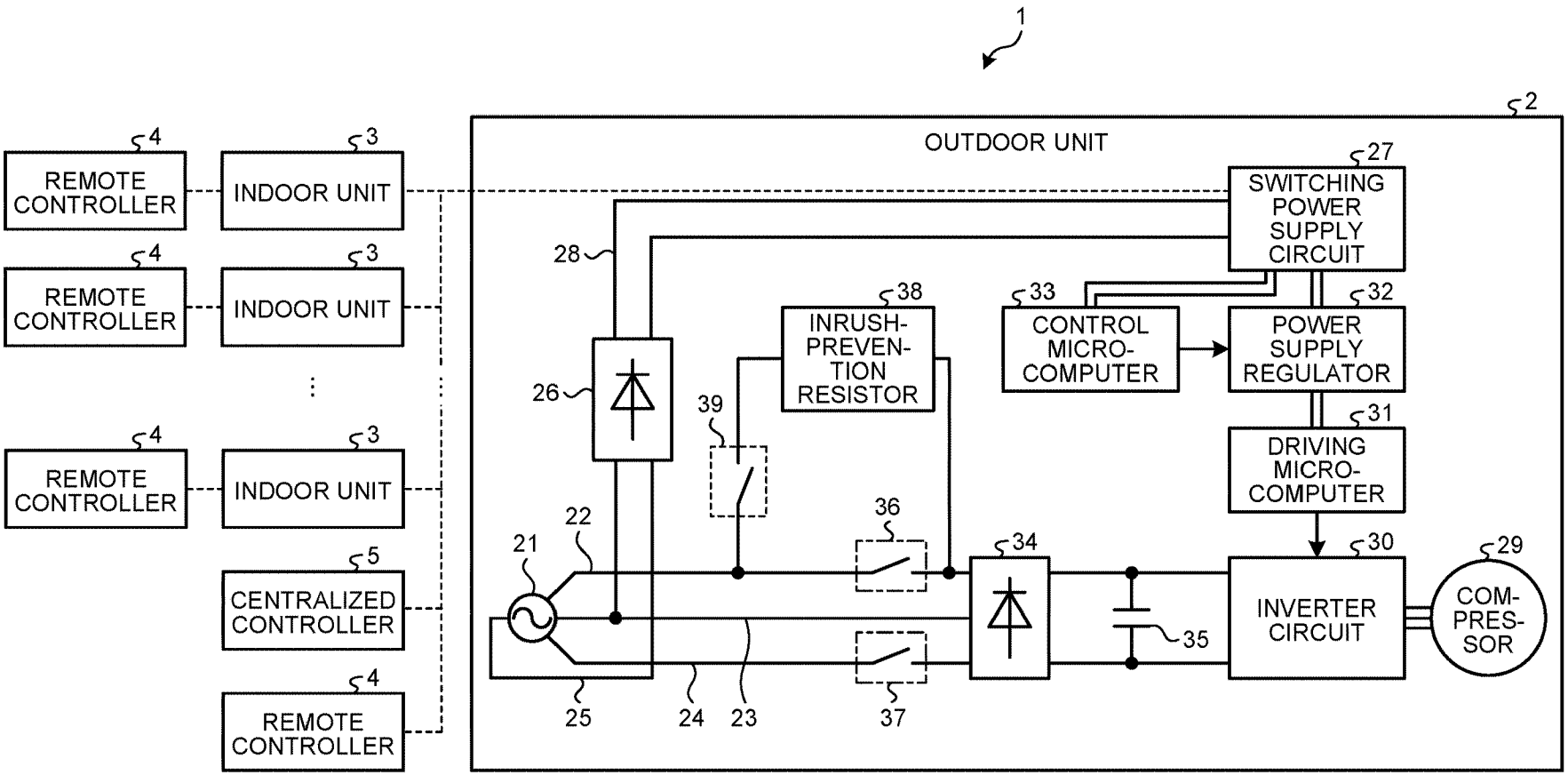
FIG. 1 is a diagram illustrating a configuration of an air conditioner according to a first embodiment.

FIG. 1 is a diagram illustrating a configuration of an air conditioner 1 according to a first embodiment. The air conditioner 1 includes an outdoor unit 2 and a plurality of indoor units 3 connected to the outdoor unit 2. There is only one outdoor unit 2 in the air conditioner 1. Although FIG. 1 also illustrates an internal configuration of the outdoor unit 2, the internal configuration of the outdoor unit 2 will be described later with reference to FIG. 2.

The air conditioner 1 further includes a plurality of remote controllers 4. Each of the plurality of remote controllers 4 is connected to the outdoor unit 2 or a corresponding indoor unit 3 among the plurality of indoor units 3, and controls the connected outdoor unit 2 or indoor unit 3. The air conditioner 1 further includes a centralized controller 5 that is connected to the outdoor unit 2 and controls the outdoor unit 2. The outdoor unit 2 constantly communicates with the plurality of indoor units 3, the plurality of remote controllers 4, and the centralized controller 5.

Figure 2:
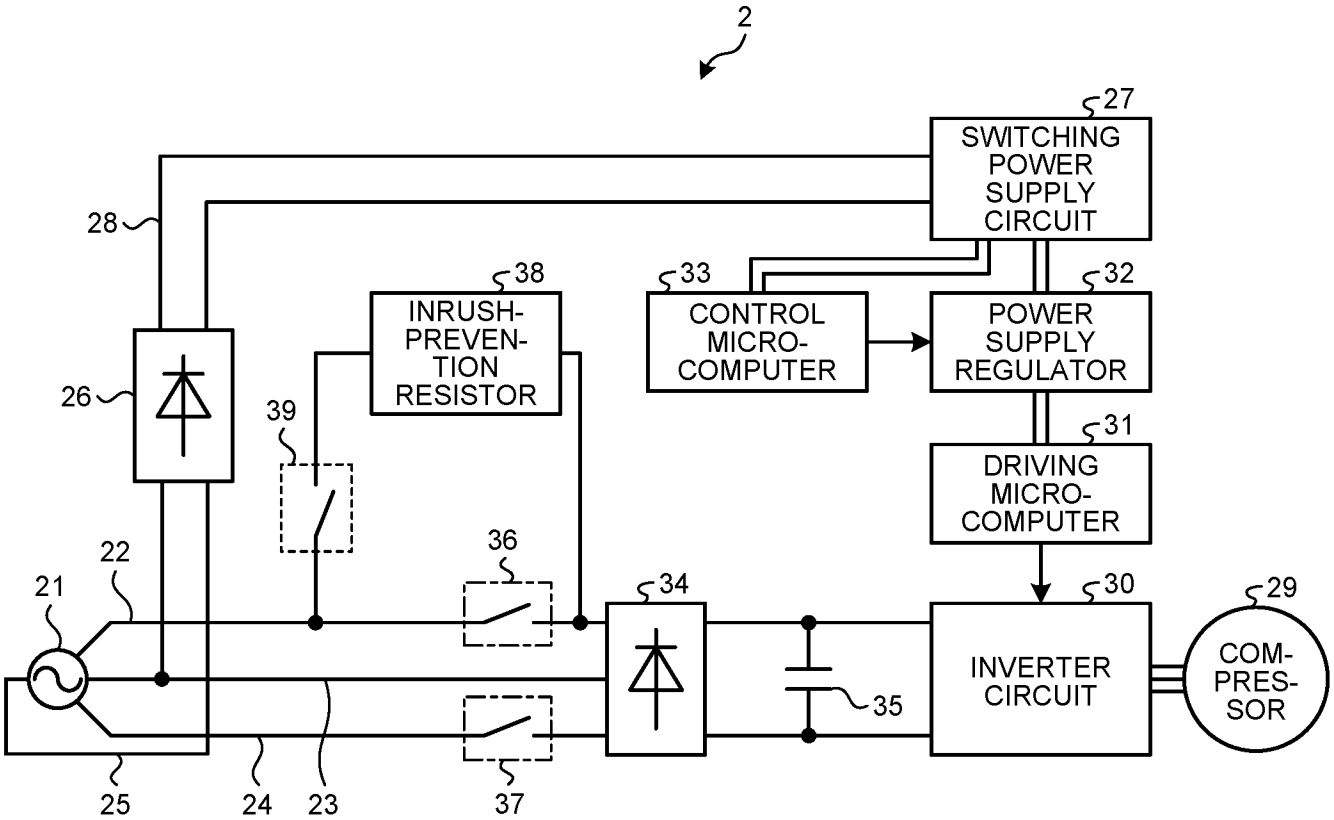
FIG. 2 is a diagram illustrating a configuration of an outdoor unit included in the air conditioner according to the first embodiment.

FIG. 2 is a diagram illustrating a configuration of the outdoor unit 2 included in the air conditioner 1 according to the first embodiment. The outdoor unit 2 includes a three-phase AC power supply 21 of a three-phase four-wire system, and a first wiring line 22, a second wiring line 23, a third wiring line 24, and a fourth wiring line 25 which are connected to the three-phase AC power supply 21. The first wiring line 22 corresponds to an L1 phase, the second wiring line 23 corresponds to an L2 phase, the third wiring line 24 corresponds to an L3 phase, and the fourth wiring line 25 corresponds to a neutral line. Each of the L1 phase, the L2 phase, and the L3 phase is a single-phase alternating current phase in a three-phase alternating current, and is a single-phase alternating current phase having a phase different from other two phases among the three phases.

The outdoor unit 2 further includes: a first diode bridge 26 that rectifies an AC power output from the three-phase AC power supply 21 into a DC power; a switching power supply circuit 27; and a path 28 for supply of DC power rectified by the first diode bridge 26 to the switching power supply circuit 27. The second wiring line 23 and the fourth wiring line 25 are connected to the first diode bridge 26.

The outdoor unit 2 further includes a compressor 29 that compresses a refrigerant, an inverter circuit 30 that controls the compressor 29, and a driving microcomputer 31 that drives the inverter circuit 30. The outdoor unit 2 further includes a power supply regulator 32 having a function of switching output of the driving microcomputer 31 between on and off, and a control microcomputer 33 that controls the power supply regulator 32.

The switching power supply circuit 27 supplies DC power rectified by the first diode bridge 26 to the control microcomputer 33. The switching power supply circuit 27 supplies DC power to the driving microcomputer 31 via the power supply regulator 32 under control of the control microcomputer 33. Note that the switching power supply circuit 27 may not be controlled by the control microcomputer 33. The driving microcomputer 31 drives the inverter circuit 30 on the basis of the supplied DC power. That is, the control microcomputer 33 outputs an instruction for controlling the compressor 29. Although not illustrated in FIGS. 1 and 2, the outdoor unit 2 includes a fan motor, and the control microcomputer 33 also outputs an instruction for controlling the fan motor.

The outdoor unit 2 further includes: a second diode bridge 34 having one side connected to the three-phase AC power supply 21 by the first wiring line 22, the second wiring line 23, and the third wiring line 24; and a smoothing capacitor 35 connected to another side of the second diode bridge 34. The inverter circuit 30 is connected to the smoothing capacitor 35. Moreover, the second diode bridge 34 is connected to the inverter circuit 30 via the smoothing capacitor 35.

The outdoor unit 2 further includes: a first relay 36 disposed on the first wiring line 22 connecting the three-phase AC power supply 21 and the second diode bridge 34; and a second relay 37 disposed on the third wiring line 24 connecting the three-phase AC power supply 21 and the second diode bridge 34. Similarly to the first wiring line 22 and the third wiring line 24, the second wiring line 23 connects the three-phase AC power supply 21 and the second diode bridge 34. A connection state of each of the second diode bridge 34 and the inverter circuit 30 with the three-phase AC power supply 21 is determined by an on state and an off state of the first relay 36 and the second relay 37.

The outdoor unit 2 further includes an inrush-prevention resistor 38 that prevents an inrush current flowing through the smoothing capacitor 35 for charging when the first relay 36 is turned on. That is, the inrush-prevention resistor 38 prevents an inrush current flowing when the power is turned on. The inrush-prevention resistor 38 is connected to the second diode bridge 34 side of the first relay 36. The outdoor unit 2 further includes a third relay 39 connected to the inrush-prevention resistor 38 and a location on the three-phase AC power supply 21 side from the first relay 36 in the first wiring line 22. In order to prevent the inverter circuit from being energized in a state in which the first relay 36 and the second relay 37 are in the off state, the third relay 39 opens and closes the inrush-prevention resistor 38.

Figure 3:
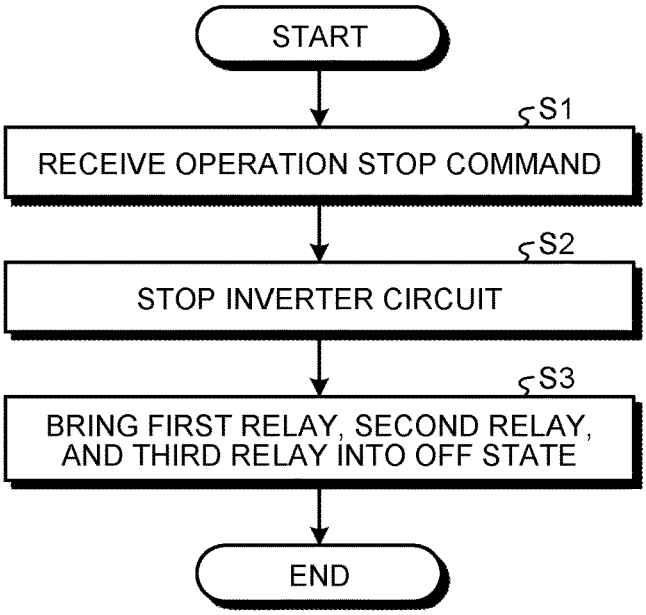
FIG. 3 is a flowchart illustrating a procedure of an operation of the outdoor unit included in the air conditioner according to the first embodiment.

Next, an operation of the outdoor unit 2 will be described. FIG. 3 is a flowchart illustrating a procedure of an operation of the outdoor unit 2 included in the air conditioner 1 according to the first embodiment. At the time of stopping the operation of the air conditioner 1, the control microcomputer 33 receives an operation stop command (S1) and stops the inverter circuit 30 (S2). The driving microcomputer 31 brings the first relay 36, the second relay 37, and the third relay 39 into the off state (S3).

More specifically, after the operation of the outdoor unit 2 stops and the compressor 29 stops, the control microcomputer 33 outputs, to the driving microcomputer 31, an instruction to bring the first relay 36, the second relay 37, and the third relay 39 into the off state. In accordance with the instruction, the driving microcomputer 31 brings the first relay 36, the second relay 37, and the third relay 39 into the off state, and disconnects the second diode bridge 34 and the inverter circuit 30 from the three-phase AC power supply 21.

As described above, during standby when the compressor 29 is not driven, the unused second diode bridge 34 and the inverter circuit 30 are disconnected from the three-phase AC power supply 21. Therefore, the air conditioner 1 according to the first embodiment can reduce electric power consumed by the second diode bridge 34 and the inverter circuit 30 during standby. That is, the air conditioner 1 can reduce power consumption during standby.

Second Embodiment

A configuration of an air conditioner according to a second embodiment is identical to the configuration of the air conditioner 1 according to the first embodiment. A part of an operation of the air conditioner according to the second embodiment is different from the operation of the air conditioner 1. In the second embodiment, differences from the first embodiment will be described.

Figure 4:
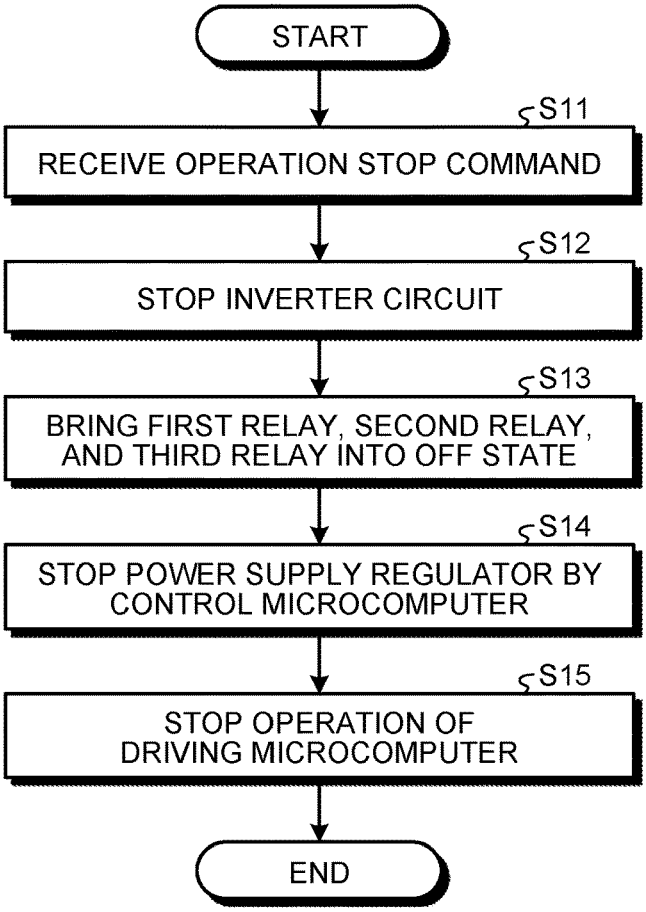
FIG. 4 is a flowchart illustrating a procedure of an operation of an outdoor unit included in an air conditioner according to a second embodiment.

FIG. 4 is a flowchart illustrating a procedure of an operation of the outdoor unit 2 included in the air conditioner according to the second embodiment. At the time of stopping the operation of the air conditioner, the control microcomputer 33 receives an operation stop command (S11) and stops the inverter circuit 30 (S12). The driving microcomputer 31 brings the first relay 36, the second relay 37, and the third relay 39 into the off state (S13). The control microcomputer 33 stops the power supply regulator 32 (S14). The driving microcomputer 31 stops the operation (S15).

That is, in the second embodiment, after the compressor 29 stops, the operations from step S1 to step S3 described in the first embodiment are performed, and thereafter, the control microcomputer 33 stops the power supply regulator 32. As described in the first embodiment, the switching power supply circuit 27 supplies DC power to the driving microcomputer 31 via the power supply regulator 32 under control of the control microcomputer 33.

In the second embodiment, since the control microcomputer 33 stops the power supply regulator 32 after the compressor 29 stops, DC power is not supplied to the driving microcomputer 31 that drives the inverter circuit 30. That is, the air conditioner according to the second embodiment can reduce electric power consumed by the driving microcomputer 31 during standby, in addition to electric power consumed by the second diode bridge 34 and the inverter circuit 30.

Third Embodiment

Figure 5:
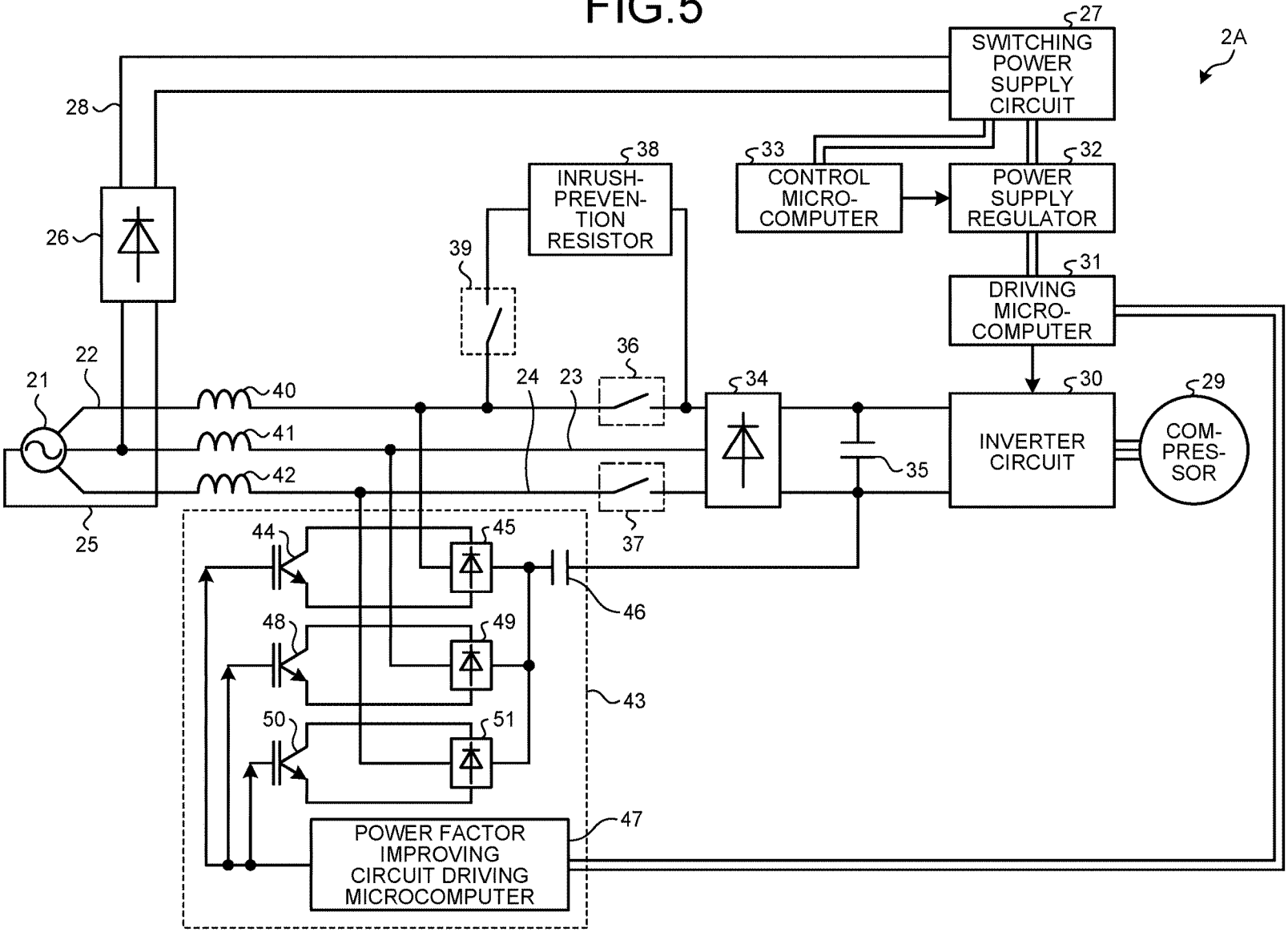
FIG. 5 is a diagram illustrating a configuration of an outdoor unit included in an air conditioner according to a third embodiment.

FIG. 5 is a diagram illustrating a configuration of an outdoor unit 2A included in an air conditioner according to a third embodiment. The air conditioner according to the third embodiment includes the outdoor unit 2A instead of the outdoor unit 2 included in the air conditioner 1 according to the first embodiment. The third embodiment is different from the first embodiment only in that the outdoor unit 2 of the first embodiment is replaced with the outdoor unit 2A. In the third embodiment, differences from the first embodiment will be mainly described.

The outdoor unit 2A includes all the components included in the outdoor unit 2. The outdoor unit 2A further includes: a first reactor 40 disposed on the three-phase AC power supply 21 side from a location where the third relay 39 is connected on the first wiring line 22; a second reactor 41 disposed on the second wiring line 23; and a third reactor 42 disposed on the three-phase AC power supply 21 side from the second relay 37 on the third wiring line 24.

The outdoor unit 2A further includes a power factor improving circuit 43. The power factor improving circuit 43 includes: a first insulated-gate bipolar transistor 44; a third diode bridge 45 connected to the first insulated-gate bipolar transistor 44; a resonant capacitor 46 connected to the third diode bridge 45; and a power factor improving circuit driving microcomputer 47 that drives the first insulated-gate bipolar transistor 44. One end portion of the third diode bridge 45 is connected to a location on the first wiring line 22 between the first reactor 40 and a location where the third relay 39 is connected. The resonant capacitor 46 is also connected to the inverter circuit 30. The power factor improving circuit driving microcomputer 47 is connected to the driving microcomputer 31.

The power factor improving circuit 43 further includes a second insulated-gate bipolar transistor 48 and a fourth diode bridge 49 connected to the second insulated-gate bipolar transistor 48. One end portion of the fourth diode bridge 49 is connected to a location on the second wiring line 23 between the second reactor 41 and the second diode bridge 34. The fourth diode bridge 49 is also connected to the resonant capacitor 46. The power factor improving circuit driving microcomputer 47 also drives the second insulated-gate bipolar transistor 48.

The power factor improving circuit 43 further includes a third insulated-gate bipolar transistor 50 and a fifth diode bridge 51 connected to the third insulated-gate bipolar transistor 50. One end portion of the fifth diode bridge 51 is connected to a location on the third wiring line 24 between the third reactor 42 and the second relay 37. The fifth diode bridge 51 is also connected to the resonant capacitor 46. The power factor improving circuit driving microcomputer 47 also drives the third insulated-gate bipolar transistor 50.

To the power factor improving circuit driving microcomputer 47, power is supplied via the power supply regulator 32 and the driving microcomputer 31. When the control microcomputer 33 stops output of the power supply regulator 32, the supply of electric power to the driving microcomputer 31 and the power factor improving circuit driving microcomputer 47 is stopped.

Figure 6:
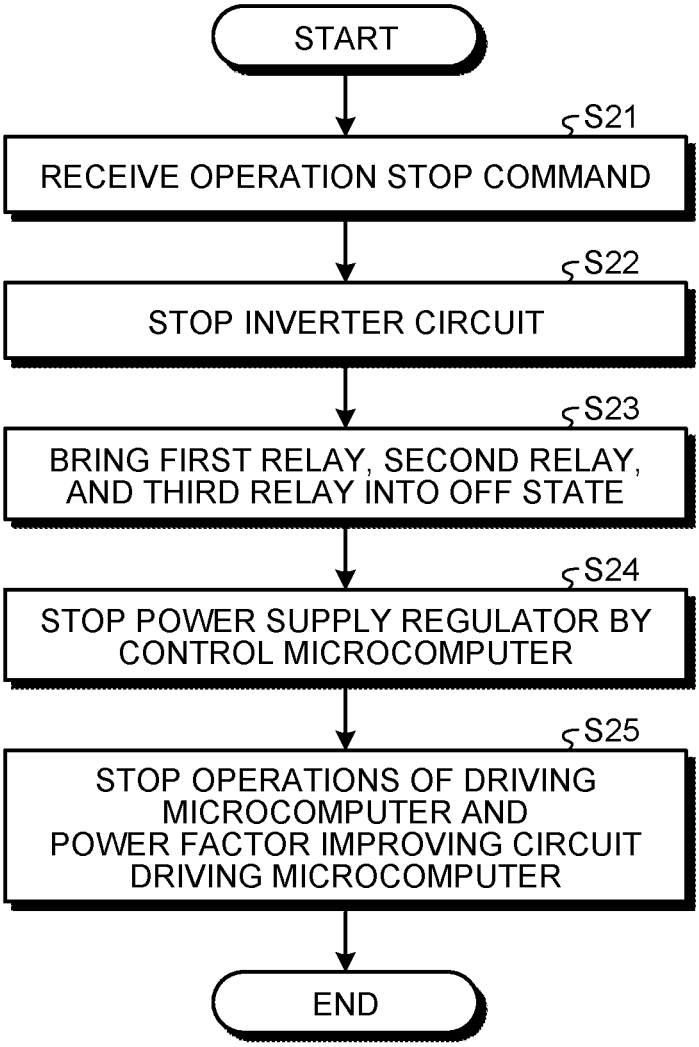
FIG. 6 is a flowchart illustrating a procedure of an operation of the outdoor unit included in the air conditioner according to the third embodiment.

FIG. 6 is a flowchart illustrating a procedure of an operation of the outdoor unit 2A included in the air conditioner according to the third embodiment. At the time of stopping the operation of the air conditioner, the control microcomputer 33 receives an operation stop command (S21) and stops the inverter circuit 30 (S22). The driving microcomputer 31 brings the first relay 36, the second relay 37, and the third relay 39 into the off state (S23). The control microcomputer 33 stops the power supply regulator 32 (S24). The driving microcomputer 31 and the power factor improving circuit driving microcomputer 47 stop operations (S25).

That is, in the third embodiment, after the compressor 29 stops, the operations from step S1 to step S3 described in the first embodiment are performed, and thereafter, the control microcomputer 33 stops the power supply regulator 32. Under control of the control microcomputer 33, the switching power supply circuit 27 supplies DC power to the driving microcomputer 31 and the power factor improving circuit driving microcomputer 47 via the power supply regulator 32 whose output can be stopped by the control microcomputer 33. As described above, the switching power supply circuit 27 may not be controlled by the control microcomputer 33.

In the third embodiment, since the control microcomputer 33 stops the power supply regulator 32 after the compressor 29 stops, DC power is not supplied to the driving microcomputer 31 that drives the inverter circuit 30. DC power is also not supplied to the power factor improving circuit driving microcomputer 47 that is for driving the first insulated-gate bipolar transistor 44, the second insulated-gate bipolar transistor 48, and the third insulated-gate bipolar transistor 50 which are included in the power factor improving circuit 43.

Therefore, the air conditioner according to the third embodiment can reduce electric power consumed by the driving microcomputer 31 and the power factor improving circuit driving microcomputer 47 during standby, in addition to electric power consumed by the second diode bridge 34 and the inverter circuit 30. Furthermore, the air conditioner according to the third embodiment can reduce power consumption during standby in a situation where the power factor improving circuit 43 is included.

Fourth Embodiment

Figure 7:
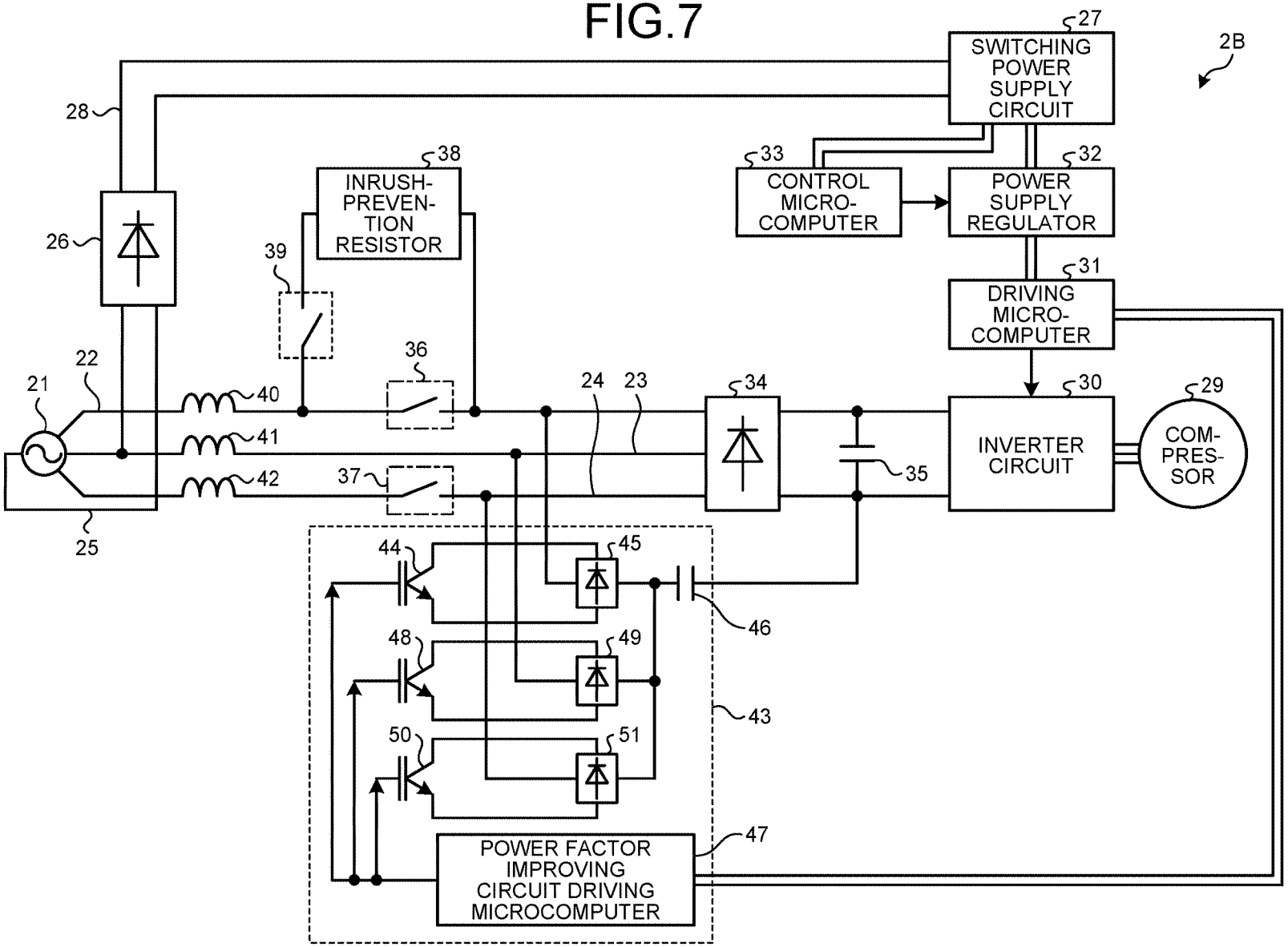
FIG. 7 is a diagram illustrating a configuration of an outdoor unit included in an air conditioner according to a fourth embodiment.

FIG. 7 is a diagram illustrating a configuration of an outdoor unit 2B included in an air conditioner according to a fourth embodiment. The air conditioner according to the fourth embodiment includes the outdoor unit 2B instead of the outdoor unit 2A included in the air conditioner according to the third embodiment. The fourth embodiment is different from the third embodiment only in that the outdoor unit 2A of the third embodiment is replaced with the outdoor unit 2B. In the fourth embodiment, differences from the third embodiment will be mainly described.

The outdoor unit 2B includes all the components of the outdoor unit 2A. A location where the power factor improving circuit 43 is connected to each of the first wiring line 22, the second wiring line 23, and the third wiring line 24 is different between the outdoor unit 2B of the fourth embodiment and the outdoor unit 2A of the third embodiment. Specifically, in the outdoor unit 2B, one end portion of the third diode bridge 45 is connected to a location on the first wiring line 22 between the second diode bridge 34 and a location where the inrush-prevention resistor 38 is connected.

One end portion of the fourth diode bridge 49 is connected to a location on the second wiring line 23 between the second reactor 41 and the second diode bridge 34. One end portion of the fifth diode bridge 51 is connected to a location on the third wiring line 24 between the second relay 37 and the second diode bridge 34.

In the fourth embodiment, after the compressor 29 stops, the operations from step S1 to step S3 described in the first embodiment are performed, and thereafter, the control microcomputer 33 stops the power supply regulator 32. Therefore, DC power is not supplied to the driving microcomputer 31 that drives the inverter circuit 30. DC power is also not supplied to the power factor improving circuit driving microcomputer 47 that is for driving the first insulated-gate bipolar transistor 44, the second insulated-gate bipolar transistor 48, and the third insulated-gate bipolar transistor 50 which are included in the power factor improving circuit 43.

Therefore, the air conditioner according to the fourth embodiment can reduce electric power consumed by the driving microcomputer 31 and the power factor improving circuit driving microcomputer 47 during standby, in addition to electric power consumed by the second diode bridge 34 and the inverter circuit 30.

Figure 8:
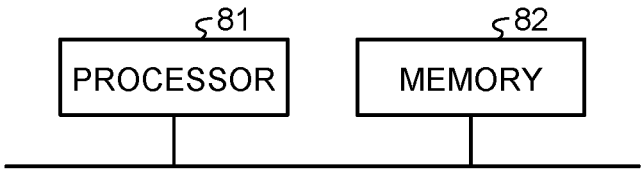
FIG. 8 is a diagram illustrating a processor in a case where a part of each of a plurality of remote controllers included in the air conditioner according to the first embodiment is implemented by the processor.

FIG. 8 is a diagram illustrating a processor 81 in a case where a part of each of the plurality of remote controllers 4 included in the air conditioner 1 according to the first embodiment is realized by the processor 81. That is, some functions of each of the plurality of remote controllers 4 may be implemented by the processor 81 that executes a program stored in a memory 82.

The processor 81 is a central processing unit (CPU), a processing device, an arithmetic device, a microprocessor, or a digital signal processor (DSP). FIG. 8 also illustrates the memory 82.

When some functions of each of the plurality of remote controllers 4 are implemented by the processor 81, the some functions are implemented by the processor 81 and software, firmware, or a combination of software and firmware. The software or firmware is described as a program and stored in the memory 82. The processor 81 reads and executes the program stored in the memory 82 to implement some functions of each of the plurality of remote controllers 4.

When some functions of each of the plurality of remote controllers 4 are implemented by the processor 81, each of the plurality of remote controllers 4 has the memory 82 for storage of a program that causes execution of at least some of the steps executed by each of the plurality of remote controllers 4 as a result. It can also be said that the program stored in the memory 82 causes a computer to execute a part of each of the plurality of remote controllers 4.

The memory 82 is, for example, a nonvolatile or volatile semiconductor memory such as a random access memory (RAM), a read only memory (ROM), a flash memory, an erasable programmable read only memory (EPROM), or an electrically erasable programmable read-only memory (EEPROM) (registered trademark), a magnetic disk, a flexible disk, an optical disk, a compact disk, a mini disk, a digital versatile disk (DVD), or the like.

Figure 9:
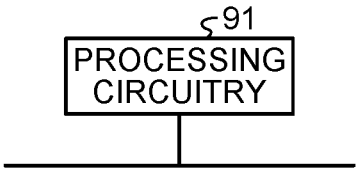
FIG. 9 is a diagram illustrating processing circuitry in a case where a part of each of the plurality of remote controllers included in the air conditioner according to the first embodiment is implemented by the processing circuitry.

FIG. 9 is a diagram illustrating processing circuitry 91 in a case where a part of each of the plurality of remote controllers 4 included in the air conditioner 1 according to the first embodiment is implemented by the processing circuitry 91. That is, a part of each of the plurality of remote controllers 4 may be realized by the processing circuitry 91.

The processing circuitry 91 is dedicated hardware. The processing circuitry 91 is, for example, a single circuit, a composite circuit, a programmed processor, a parallel-programmed processor, an application specific integrated circuit (ASIC), a field-programmable gate array (FPGA), or a combination thereof.

A part of each of the plurality of remote controllers 4 may be realized by dedicated hardware separate from the rest.

Some of the plurality of functions of each of the plurality of remote controllers 4 may be implemented by software or firmware, and the rest of the plurality of functions may be implemented by dedicated hardware. As described above, the plurality of functions of each of the plurality of remote controllers 4 can be realized by hardware, software, firmware, or a combination thereof.

A part of the centralized controller 5 included in the air conditioner 1 according to the first embodiment may be realized by a processor or processing circuitry. The processor is a processor similar to the processor 81 described above. The processing circuitry is processing circuitry similar to the processing circuitry 91 described above.

The configurations described in the above embodiments are examples and can be combined with another known technique, the embodiments can be combined with each other, and a part of the configuration can be omitted or modified without departing from the gist.

The invention claimed is:

1. An air conditioner comprising:

an outdoor unit;

a plurality of indoor units connected to the outdoor unit;

a plurality of remote controllers; and a centralized controller to control the outdoor unit, wherein each of the plurality of remote controllers controls the outdoor unit or a corresponding indoor unit among the plurality of indoor units, the outdoor unit constantly communicates with the plurality of indoor units, the plurality of remote controllers, and the centralized controller, the outdoor unit includes:

a three-phase alternating current (AC) power supply;

a first diode bridge to rectify AC power output from the three-phase AC power supply into direct current (DC) power;

a compressor to compress a refrigerant;

a control microcomputer to output an instruction for controlling the compressor;

an inverter circuit to control the compressor;

a driving microcomputer to drive the inverter circuit;

a switching power supply circuit to supply DC power rectified by the first diode bridge to the control microcomputer and the driving microcomputer;

a second diode bridge connected to the inverter circuit;

a first wiring line corresponding to an L1 phase and connecting the three-phase AC power supply and the second diode bridge;

a second wiring line corresponding to an L2 phase and connecting the three-phase AC power supply and the second diode bridge;

a third wiring line corresponding to an L3 phase and connecting the three-phase AC power supply and the second diode bridge;

a first relay disposed on the first wiring line;

a second relay disposed on the third wiring line;

an inrush-prevention resistor to prevent an inrush current flowing when power is turned on, the inrush-prevention resistor being connected to the second diode bridge side of the first relay; and a third relay connected to the inrush-prevention resistor and a location on the three-phase AC power supply side from the first relay on the first wiring line, wherein after the compressor stops, the driving microcomputer brings the first relay, the second relay, and the third relay into an off state, and disconnects the second diode bridge and the inverter circuit from the three-phase AC power supply, the outdoor unit further includes a power supply regulator having a function of switching output of the driving microcomputer between on and off, and the control microcomputer stops the power supply regulator after the compressor stop.

2. The air conditioner according to claim 1, wherein the outdoor unit further includes:

a first reactor disposed on the three-phase AC power supply side from a location where the third relay is connected on the first wiring line;

a second reactor disposed on the second wiring line;

a third reactor disposed on the three-phase AC power supply side from the second relay on the third wiring line; and a power factor improving circuit, the power factor improving circuit includes:

a first insulated-gate bipolar transistor;

a third diode bridge connected to the first insulated-gate bipolar transistor;

a second insulated-gate bipolar transistor;

a fourth diode bridge connected to the second insulated-gate bipolar transistor;

a third insulated-gate bipolar transistor;

a fifth diode bridge connected to the third insulated-gate bipolar transistor;

a resonant capacitor connected to the third diode bridge, the fourth diode bridge, the fifth diode bridge, and the inverter circuit; and a power factor improving circuit driving microcomputer to drive the first insulated-gate bipolar transistor, the second insulated-gate bipolar transistor, and the third insulated-gate bipolar transistor, one end portion of the third diode bridge is connected to a location on the first wiring line between the first reactor and a location where the third relay is connected, one end portion of the fourth diode bridge is connected to a location on the second wiring line between the second reactor and the second diode bridge, one end portion of the fifth diode bridge is connected to a location on the third wiring line between the third reactor and the second relay, power is supplied to the power factor improving circuit driving microcomputer via the power supply regulator, and the control microcomputer stops the power supply regulator after the compressor stops.

3. The air conditioner according to claim 1, wherein the outdoor unit further includes:

a first reactor disposed on the three-phase AC power supply side from a location where the third relay is connected on the first wiring line;

a second reactor disposed on the second wiring line;

a third reactor disposed on the three-phase AC power supply side from the second relay on the third wiring line; and a power factor improving circuit, the power factor improving circuit includes:

a first insulated-gate bipolar transistor;

a third diode bridge connected to the first insulated-gate bipolar transistor;

a second insulated-gate bipolar transistor;

a fourth diode bridge connected to the second insulated-gate bipolar transistor;

a third insulated-gate bipolar transistor;

a fifth diode bridge connected to the third insulated-gate bipolar transistor;

a resonant capacitor connected to the third diode bridge, the fourth diode bridge, the fifth diode bridge, and the inverter circuit; and a power factor improving circuit driving microcomputer to drive the first insulated-gate bipolar transistor, the second insulated-gate bipolar transistor, and the third insulated-gate bipolar transistor, one end portion of the third diode bridge is connected to a location on the first wiring line between the second diode bridge and a location where the inrush-prevention resistor is connected, one end portion of the fourth diode bridge is connected to a location on the second wiring line between the second reactor and the second diode bridge, one end portion of the fifth diode bridge is connected to a location on the third wiring line between the second relay and the second diode bridge, power is supplied to the power factor improving circuit driving microcomputer via the power supply regulator, and the control microcomputer stops the power supply regulator after the compressor stops.

* * * * *